United States Patent [19]

Hastie

[11] Patent Number: 4,844,433

[45] Date of Patent: Jul. 4, 1989

[54] PACKER BOX UNDERSIZED SIGNATURE HANDLING KIT

[75] Inventor: Ronald W. Hastie, Elk Grove Village, Ill.

[73] Assignee: R. R. Donnelley & Sons Company, Chicago, Ill.

[21] Appl. No.: 179,883

[22] Filed: Apr. 11, 1988

[51] Int. Cl.[4] ..... B65H 39/02

[52] U.S. Cl. ..... 270/54

[58] Field of Search ..... 270/54, 55, 56, 57, 270/58; 271/225

[56] References Cited

U.S. PATENT DOCUMENTS

| | | | |
|---|---|---|---|
| 2,855,195 | 10/1958 | Young | 270/54 |
| 3,087,721 | 4/1963 | McCain | 270/54 |
| 3,806,111 | 4/1974 | Lachman | 270/54 |
| 3,880,418 | 4/1975 | Swanson | 270/54 |
| 4,299,378 | 11/1981 | Müller | 270/54 |
| 4,350,352 | 9/1982 | Müller | 270/54 |
| 4,491,311 | 1/1985 | Glanzman | 270/54 |
| 4,564,186 | 1/1986 | Clarke, Jr. et al. | 270/54 |
| 4,625,952 | 12/1986 | Schniter | 270/54 |

*Primary Examiner*—Robert E. Garrett
*Assistant Examiner*—Therese Newholm
*Attorney, Agent, or Firm*—Wood, Dalton, Phillips Mason & Rowe

[57] ABSTRACT

A kit for handling undersized signatures in a packer box having a signature feeding station, a main drum assembly, a delivery drum assembly and a continuous signature carrying chain. The kit includes a pair of register stop extensions adapted to be disposed in cooperative relation with spaced apart register stops. It also includes at least one guide roller extension bracket adapted to carry a guide roller which is removable from the bracket normally supporting the guide roller and is securable on the guide roller extension bracket for rolling movement relative thereto. The kit further includes a timing adjustment feature for causing grippers to release signatures at a point generally corresponding to the remote end of the guide roller extension bracket. With this arrangement, a packer box can be modified for handling undersized signatures.

17 Claims, 4 Drawing Sheets

FIG. 1
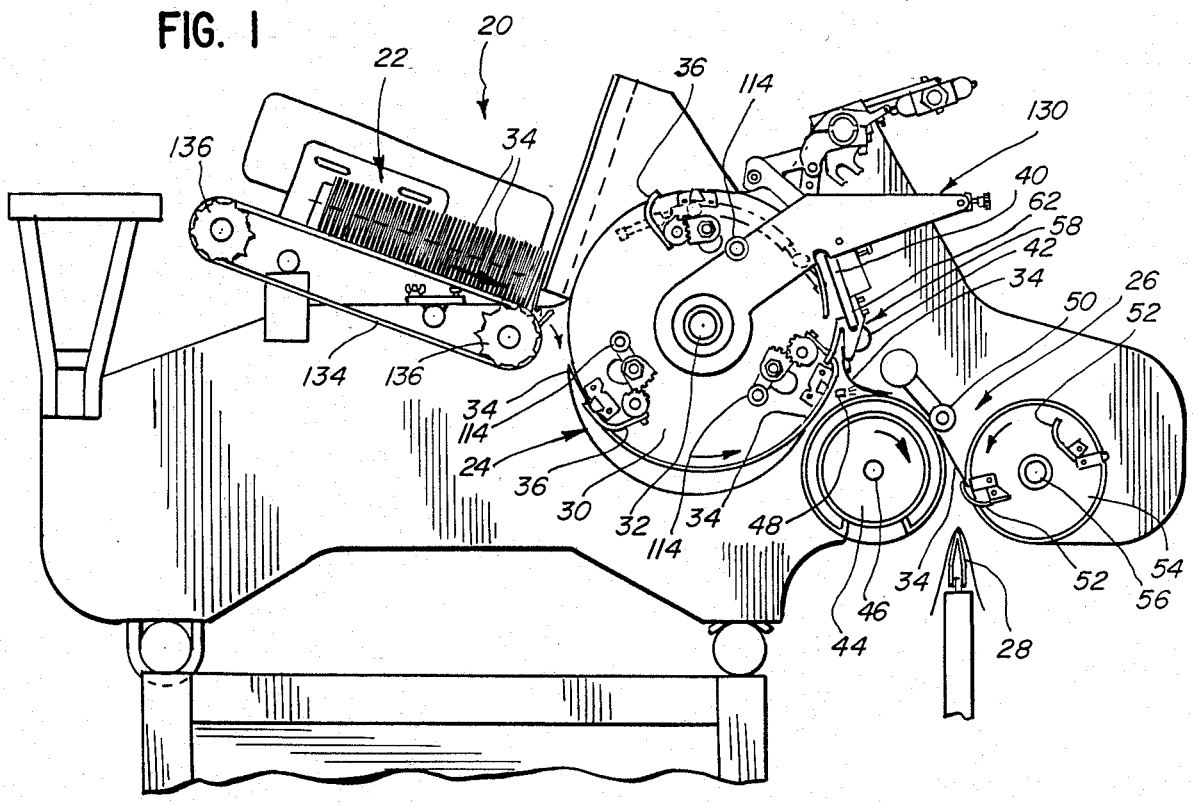
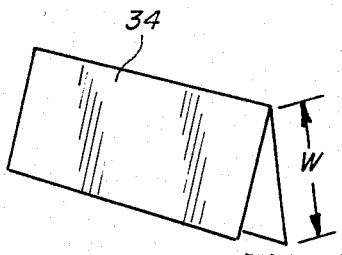
FIG. 2
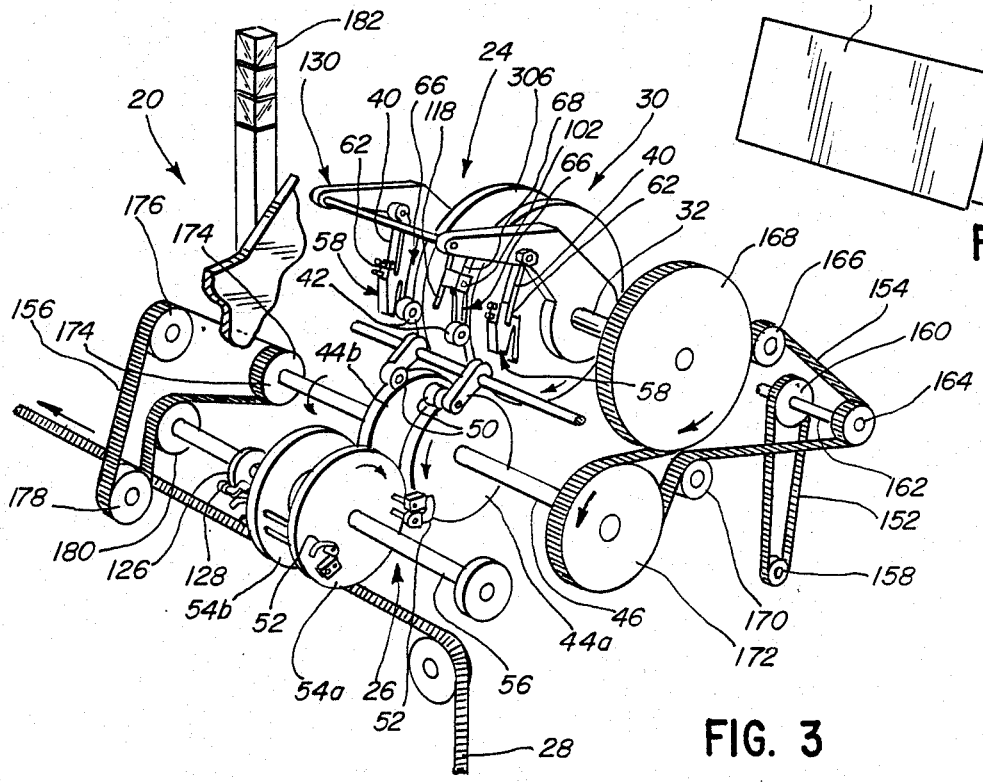
FIG. 3

FIG. 9
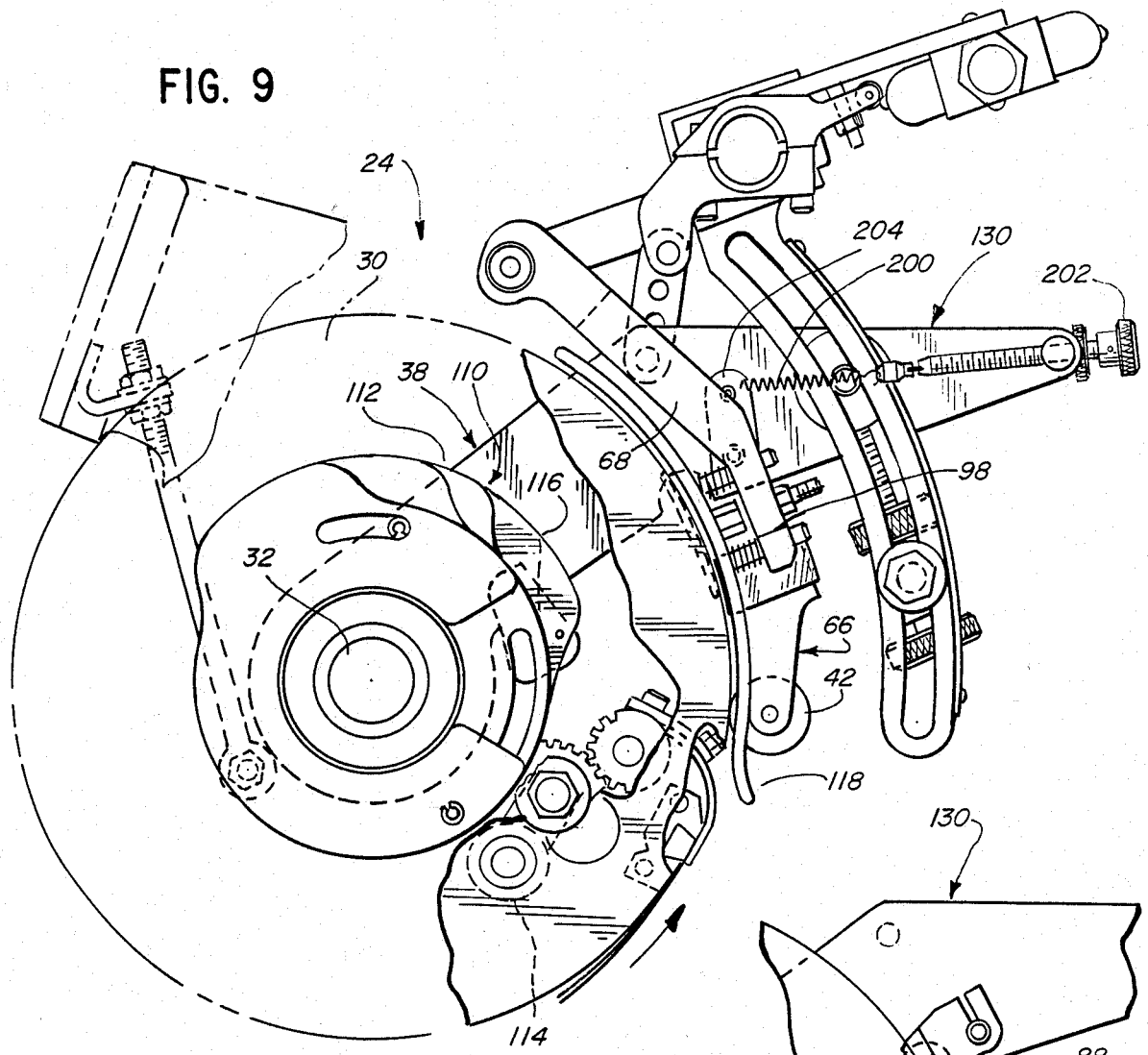
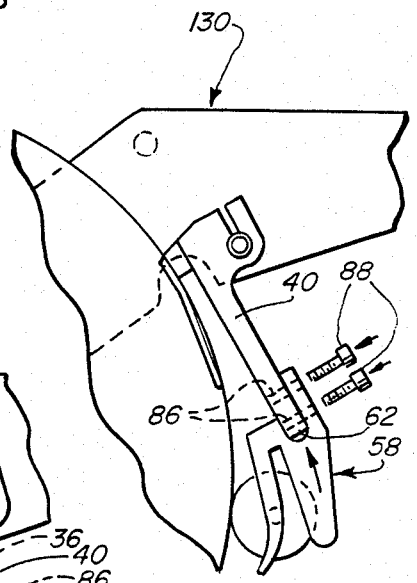
FIG. 10
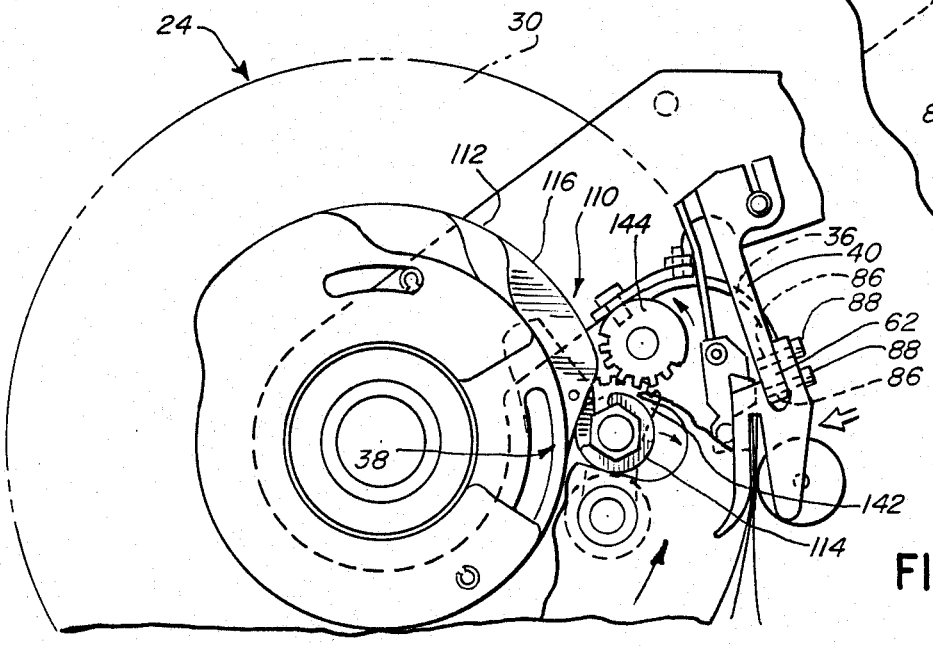
FIG. 11

PACKER BOX UNDERSIZED SIGNATURE HANDLING KIT

FIELD OF THE INVENTION

The present invention relates generally to a packer box for handling signatures and, more particularly, to a kit for handling undersized signatures in such a packer box.

BACKGROUND OF THE INVENTION

In recent years, many large circulation periodicals have appeared which require rapid handing of portions of the periodicals consisting of signatures which are gathered for stitching, trimmed, bundled for minimum shipping costs, and shipped. A typical operation utilizes a multitude of packer boxes each of which receives signatures seriatum from a signature supply means, opens each signature, and drops the signatures successively straddling a gathering chain that runs in front of the packer boxes and carries the complete collection of gathered signatures to the stitcher. Moreover, because of the need for highly efficient plant operations, there has been a constant effort to increase the speed at which machines operate which has required the development of new techniques for handling the signatures at all stages of a binding process.

In addition to high speed operation, many large circulation periodicals are now demanding a degree of flexibility that has been heretofore considered impossible. This is particularly true, for instance, where the periodical wishes to include one or more inserts that are significantly undersized but are to be stitched in during operation of a bindery line without significant reduction in a cyclic rate of operation which would otherwise decrease plant efficiency thereby increasing costs while possibly failing to accommodate the high volume presently produced by the U.S. printing industry which requires that the most efficient possible use be made of manpower, equipment and plant space. Furthermore, since the need for handling undersized signatures is sporadic, there has been a reluctance to produce special equipment for handling such signatures.

Even if produced, a special piece of equipment would take undue space which is at a premium in most bindery lines. It will also be appreciated that any special piece of equipment would be extremely costly at best and, in all likelihood, very difficult to develop so as to operate compatibly with the remainder of the equipment line. On the other hand, it would be most desirable to utilize present equipment with minimal modifications.

Despite the recognition of the advantages of such an approach, it has remained to provide a commercially satisfactory means for handling undersized signatures in a conventional packer box.

SUMMARY OF THE INVENTION

Accordingly, the present invention is directed to a kit for handling undersized signatures in a packer box having a signature feeding station, a main drum assembly, a delivery drum assembly and a continuous signature carrying chain. The main drum assembly includes drum means mounted for rotation on a shaft extending transversely of the direction of travel of signatures in the signature feeding station and also includes signature gripping means mounted for rotation with the drum means for gripping one signature at a time as the signature gripping means passes the signature feeding station.

In addition, the main drum assembly includes means for releasing the signatures from the signature gripping means and stopping travel of the signatures with the drum means in the form of timing means which causes the gripping means to release the signatures at a preselected point during travel of the signatures with the drum means and in the form of at least a pair of spaced apart register stops downstream of the preselected point by a preselected distance.

Further, the packer box includes at least one bracket supported guide roller in engagement with the drum means to cause the signatures to travel with the drum means from the preselected point through the preselected distance to the register stops. The delivery drum assembly comprises a transfer drum mounted for rotation in a direction opposite rotation of the main drum assembly on a shaft extending parallel to the shaft of the main drum assembly and also includes means cooperating with the transfer drum to cause the signatures to travel with the transfer drum away from the register stops toward the continuous signature carrying chain. Additionally, the delivery drum assembly includes signature opening means mounted for rotation with an opening drum in a direction opposite rotation of the transfer drum on a shaft extending parallel to the shafts of the transfer drum.

Referring to the kit in particular, it includes a corresponding number of register stop extensions adapted to be disposed in cooperative relation with the spaced apart register stops. Each of the register stop extensions has a first end adapted to be secured to a receiving end of one of the register stops and a second end defining a receiving end of the register stop extension. Further, the register stop extensions are adapted to limit travel of the signatures with the drum means.

In addition, the kit includes at least one guide roller extension bracket adapted to carry the guide roller which is removable from the bracket normally supporting the guide roller and is securable on the guide roller extension bracket for rolling movement relative thereto. Still further, the guide roller extension bracket has a first end adapted to be secured to the end of the bracket normally supporting the guide roller and a second end adapted to support the guide roller upstream of the preselected point in engagement with the drum means.

In accordance with the invention, the kit also includes timing adjustment means for causing the gripping means to release the signatures at another preselected point generally corresponding to the second end of the guide roller extension bracket. The register stop extensions are disposed downstream of the other preselected point by another preselected distance. More particularly, and in accordance with the principal object of the invention, the other preselected point and other preselected distance are adapted to accommodate handling of undersized signatures with a conventional packer box.

In a preferred embodiment, the receiving end of each of the register stops of the packer box is defined by an elongated finger. The register stop extensions then each include a channel at the first end thereof adapted to receive the elongated finger of one of the registered stops in snug-fitting relation. Advantageously, the kit includes means for securing the first ends of the register stop extensions to the elongated fingers of the register stops.

Preferably, the register stop extensions each include a signature receiving slot at the second end thereof adapted to receive one of the signatures. The slot is defined by an outer finger having a round end and an inner finger having a first portion disposed at an acute angle so as to converge toward the outer finger in a direction inwardly of the slot and a second portion disposed generally parallel to the outer finger at the innermost end thereof. With this arrangement, the inner and outer fingers define an enlarged opening into the slot to facilitate receipt of one of the signatures therein.

In the preferred embodiment, the guide roller extension bracket includes an attachment portion at the first end thereof. The attachment portion preferably includes an area of reduced thickness on one side of the guide roller extension bracket configured to correspond to the end of the bracket normally supporting the guide roller and has a hole therethrough adapted to register with a hole in the bracket normally supporting the guide roller. With this arrangement, the kit includes means for securing the attachment portion of the guide roller extension bracket to the end of the bracket normally supporting the guide roller.

Preferably, the guide roller extension bracket includes a roller supporting portion at the second end thereof. The roller supporting portion includes an area of reduced thickness on one side of the guide roller extension bracket configured to receive the guide roller in a manner where the guide roller is disposed on the drum means of the main drum assembly and has a hole therein adapted to register with a hole in the guide roller. With this arrangement, the kit includes means for securing the guide roller to the roller supporting portion of the guide roller extension bracket for rolling engagement of the guide roller with the drum means.

In the preferred embodiment, the timing means causing the gripping means to release the signatures at the preselected point during travel of the signatures with the drum means includes cam means. The cam means comprises a cam mounted in a fixed position in proximity to the drum means of the main drum assembly and a cam follower operatively associated with the gripping means and mounted for rotation with the drum means. Further, the timing adjustment means comprises a cam extension adapted to be mounted in a fixed position in cooperative relation to the cam for causing the gripping means to release the signatures at the proper time.

Still other objects, advantages and features of the present invention will become apparent from a consideration of the following specification taken in conjunction with the accompanying drawings.

BRIEF DESCRIPTION OF THE DRAWINGS

FIG. 1 is a side elevational view of a packer box utilizing a kit for handling undersized signatures in accordance with the present invention;

FIG. 2 is a perspective view of an undersized signature;

FIG. 3 is a perspective view of the packer box as illustrated in FIG. 1;

FIG. 9 is a side elevational view of a main drum assembly utilizing a kit in accordance with the present invention;

FIG. 10 is a side elevational view illustrating a register stop extension being secured to a register stop in accordance with the present invention;

FIG. 11 is a side elevational view illustrating a register stop extension being properly positioned in relation to a main drum assembly in accordance with the present invention.

DETAILED DESCRIPTION OF THE PREFERRED EMBODIMENTS

Figure 5:
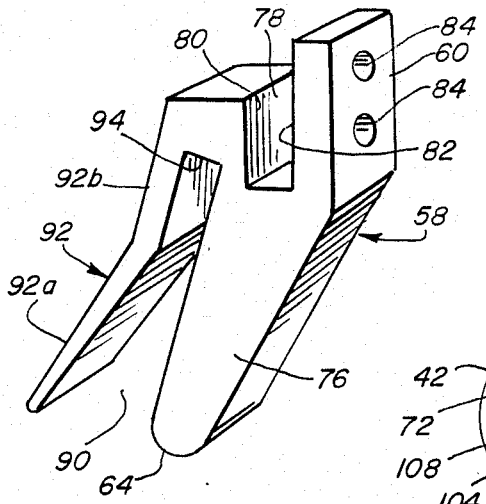
FIG. 5 is a perspective view of a register stop extension in accordance with the present invention.

Referring to the drawings, and first to FIG. 1, the reference numeral 20 designates generally a packer box having a signature feeding station 22, a main drum assembly 24, a delivery drum assembly 26 and a continuous signature carrying chain 28. The main drum assembly 24 includes drum means 30 mounted for rotation on a shaft 32 extending transversely of the direction of travel of signatures 34 in the signature feeding station 22 as indicated by the arrow. The main drum assembly 24 also includes signature gripping means 36 mounted for rotation with the drum means 30 for gripping one signature 34 at a time as the signature gripping means 36 passes the signature feeding station 22. Further, the main drum assembly 30 includes means for releasing the signatures 34 from the signature gripping means 36 and stopping travel of the signatures 34 with the drum means 30 as will be described below.

In particular, the releasing and stopping means includes timing means generally designated 38 (see FIG. 11) which causes the gripping means 36 to release the signatures 34 at a preselected point during travel of the signatures 34 with the drum means 30. The releasing and stopping means also includes at least a pair of spaced apart register stops 40 downstream of the preselected point by a preselected distance together with at least one bracket supported guide roller 42 (see FIG. 4) in engagement with the drum means 30 to cause the signatures 34 to travel with the drum means 30 from the preselected point through the preselected distance to the register stops 40. The delivery drum assembly 26 includes a transfer drum 44 mounted for rotation in a direction opposite rotation of the main drum assembly 30 on a shaft 46 extending parallel to the shaft 32 of the main drum assembly 24. The delivery drum assembly 26 also includes means such as the air supply 48 and roller 50 cooperating with the transfer drum 44 to cause the signatures 34 to travel with the transfer drum 44 away from the register stops 40 toward the continuous signature carrying chain 28. Additionally, the delivery drum assembly 26 includes signature opening means 52 mounted for rotation with an opening drum 54 in a direction opposite rotation of the transfer drum 44 on a shaft 56 extending parallel to the shaft 46 of the transfer drum 44.

With this arrangement, the packer box 20 is adapted to handle undersized signatures such as 34 (FIG. 2) by using the unique kit of the present invention. The kit includes a corresponding number of register stop extensions 58 adapted to be disposed in cooperative relation with the spaced apart register stops 40 wherein each of the register stop extensions 58 include a first end 60 adapted to be secured to a receiving end 62 of one of the register stops 40 (see FIGS. 4 and 5) and a second end 64 defining a receiving end of the register stop extension 58. As shown, the register stop extensions 58 are adapted to limit travel of the signatures 34 with the drum means 30.

Figure 6:
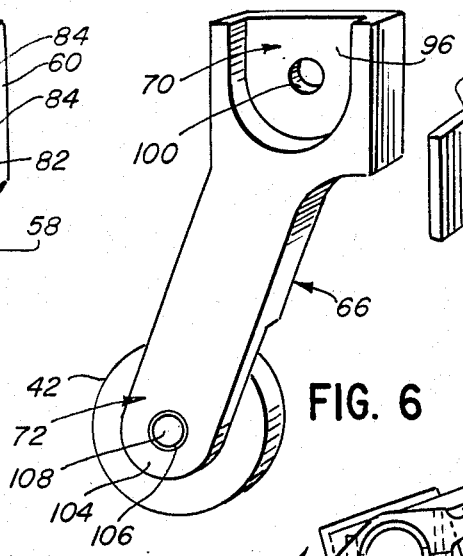
FIG. 6 is a perspective view of a guide roller extension bracket in accordance with the present invention.

Referring to FIGS. 1, 3, 6 and 9, the kit also includes at least one guide roller extension bracket 66 adapted to carry the guide roller 42 which is removable from the conventional bracket 68 (see FIG. 3) normally supporting the guide roller 42. The guide roller 42 is then securable on the guide roller extension bracket 66 for rolling movement relative thereto with the guide roller extension bracket 66 being securable to the bracket 68. As best shown in FIG. 6, the guide roller extension bracket 66 has a first end 70 adapted to be secured to the end of the bracket 68 and a second end 72 adapted to support the guide roller 42 in engagement with the drum means 30 upstream of the preselected point for the conventional packer box 20.

Figure 8:
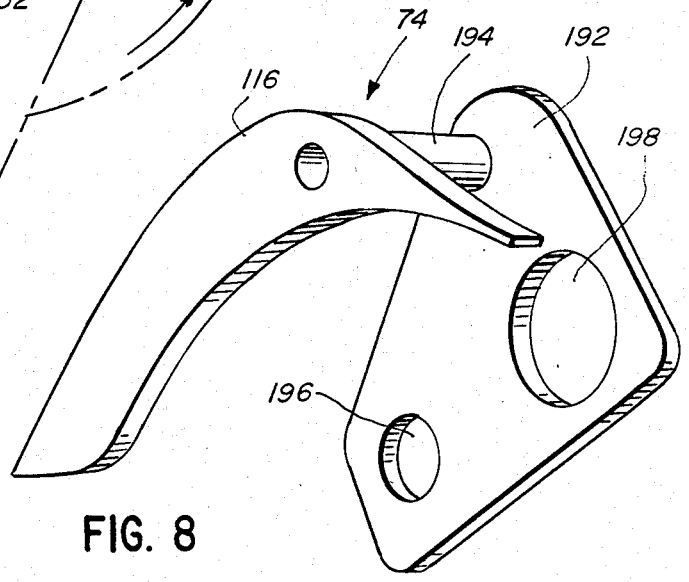
FIG. 8 is a perspective view of a cam extension in accordance with the present invention.

Referring specifically to FIGS. 8, 9 and 11, the kit further includes timing adjustment means 74 for causing the gripping means 36 to release the signatures 34 at another preselected point generally corresponding to the second end 72 of the guide roller extension bracket 66. As will be appreciated, the register stop extensions 58 are then disposed downstream of the other preselected point by another preselected distance which are adapted to accommodate handling of undersized signatures 34 (see FIG. 2).

As will also be appreciated by referring to FIGS. 1, 3, 5 and 11, the receiving end 64 of each of the register stops 58 is defined by an elongated finger 76. The register stop extensions 58 also each include a channel 78 at the first end 60 thereof adapted to receive the elongated finger 62 of one of the register stops 40 in snug-fitting relation (see, in particular, FIG. 11). Moreover, as shown, means are provided for securing the first ends 60 of the register stop extensions 58 to the elongated fingers 62 of the register stops 40.

As will be appreciated, the channel 78 of each of the register stop extensions 58 is defined by inner and outer walls 80 and 82, respectively. The outer wall 82 is greater in length than the inner wall 80 and has a pair of holes 84 extending therethrough and adapted to register with a corresponding pair of threaded holes 86 in one of the elongated fingers 62. With this arrangement, the securing means preferably includes a pair of threaded fasteners 88 adapted for threaded engagement with the threaded holes 86 in one of the elongated fingers 62.

As best shown in FIG. 5, the register stop extensions 58 each include a signature receiving slot 90 at the second end 64 thereof adapted to receive one of the signatures 34. The slot is defined by an outer finger 76 having a rounded end and an inner finger 92 having a first portion **92*a* disposed at an acute angle so as to converge toward the outer finger 76 in a direction inwardly of the slot 90 and a second portion 92*b* disposed generally parallel to the outer finger 76 at the innermost end thereof. Further, the inner and outer fingers 92 and 76 define an enlarged opening into the slot 90 to facilitate receipt of one of the signatures 34** therein.

As will be appreciated by referring to FIGS. 1 and 11, the register stop extensions 58 each are disposed relative to the drum means 30 so as to facilitate receipt of one of the signatures 34 in the signature receiving slot 90. The slot 90 is defined by a stop wall 94 at a point remote from the enlarged opening 90 against which one of the signatures 34 is stopped during travel of the signature 34 with the drum means 30. As clearly shown in FIG. 11, the inner fingers 92 have the first portions **92*a* disposed radially inwardly of the surface of the drum means 30 at least at the enlarged openings 90** thereof.

Referring to FIG. 6, the guide roller extension bracket 66 includes an attachment portion 96 at the first end 70 thereof which includes an area of reduced thickness on the one side of the guide roller extension bracket 66. This is configured to correspond to the end 98 of the bracket 68 normally supporting the guide roller 42 and has a hole 100 therethrough adapted to register with a corresponding hole (not shown) in the bracket 68 normally supporting the guide roller 42. Further, and as shown in FIG. 3, means such as a fastener 102 are provided for securing the attachment portion 96 of the guide roller extension bracket 66 to the end 98 of the bracket 68 normally supporting the guide roller 42.

Referring again to FIG. 6, the guide roller extension bracket 66 includes a roller supporting portion 104 at the second end 72 thereof which includes an area of reduced thickness on one side of the guide roller extension bracket 66. This area of reduced thickness is configured to receive the guide roller 42 in a manner where the guide roller 42 is disposed on the drum means 30 of the main drum assembly 24 and has a hole 106 therein adapted to register with a hole in the guide roller 42. With this arrangement, means such as a fastener 108 is provided for securing the guide roller 42 to the roller supporting portion 104 of the guide roller extension bracket 66 for rolling engagement of the guide roller 42 with the drum means 30.

As best shown in FIG. 3, the drum means 30 preferably includes first and second drum portions **30*a* and 30*b* disposed in spaced relation along the shaft 32 and including a pair of guide rollers 42 with one of the guide rollers 42 being in engagement with each of the first and second drum portions 30*a* and 30*b*. With this arrangement, the kit will include a pair of guide roller extension brackets 66 adapted to carry the guide rollers 42. As will be appreciated, the guide rollers 42 are removable from the brackets 68 normally supporting the guide rollers 42 and are securable on the guide roller extension brackets 66 for rolling movement on the first and second drum portions 30*a* and 30*b***, respectively.

Referring once again to FIGS. 8, 9 and 11, the timing means 38 includes cam means 110 causing the gripping means 36 on the drum means 30 of the main drum assembly 24 to release the signatures 34 at the preselected point during travel of the signatures 34 with the drum means 30. The cam means 110 includes a cam 112 adjustably mounted in a fixed position of adjustment in proximity to the drum means 30 of the main drum assembly 24 and a cam follower 114 operatively associated with a gripping means 36 and mounted for rotation with the drum means 30. Further, the timing adjustment means 74 comprises a cam extension 116 adapted to be adjustably mounted in a fixed position of adjustment in cooperative relation to the cam 112 for causing the gripping means 36 to release the signatures 34 at the other preselected point generally corresponding to the second end 72 of the guide roller extension bracket 66.

Figure 7:
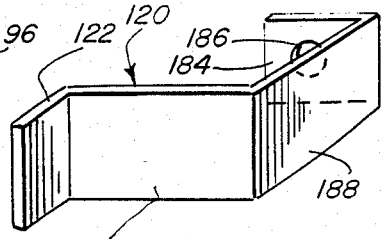
FIG. 7 is a perspective view of a choke up detector bracket in accordance with the present invention.

In a packer box 20, there is usually provided choke up detection means such as an elongated finger 118 (see FIG. 4) disposed in proximity to the drum means 30 of the main drum assembly 24. The elongated finger 118 is disposed proximate the surface of the drum means 30 of the main drum assembly 34 and is movable away from the surface of the drum means (see the arrow) in the event of a choke up of the signatures 34 to stop operation of the packer box 20 as well as all other packer boxes in a particular bindery line, i.e., it stops the operation of the bindery line, and this is achieved e.g., by means of a microswitch positioned in proximity to the elongated finger 118. In the kit of the present invention, a choke up detector bracket 120 is provided as shown in FIGS. 3 and 7 and the choke up extension bracket 120 is disposed between the drum means 30 and the elongated finger 118 of the choke up detection means.

As will be appreciated by referring to FIG. 3, this is necessary due to the positioning of the register stop extensions 58 upstream of the elongated finger 118. Thus, by securing the choke up detector bracket 120 to one of the two guide roller extension brackets 66 substantially as shown such that a flange 122 thereof is under the elongated finger 118, a choke up will raise the guide rollers 42 which will raise the guide roller extension brackets 66 causing the choke up detector bracket 120 to raise the elongated finger 118. In this manner, the choke up detection means is fully operative despite the modified structure utilized to handle undersized signatures.

Referring to FIGS. 1 and 2, the signature opening means 52 includes at least one gripper for gripping one signature 34 at a time as the signature 34 passes between the transfer drum 44 and the opening drum 54 as described in greater detail in my copending application Ser. No. 179,887, filed on the same date which is incorporated herein by reference. It will also be appreciated that the packer box 20 will include timing means 124 causing the gripper 52 to grip the signature 34 at a first preselected point when the signature 34 is between the transfer drum 44 and the opening drum 54 and to release the signature 34 at a second preselected point when the signature 34 is opened and disposed over the continuous signature carrying chain 28. As shown, the timing means 124 includes a cam 126 mounted in a fixed position in proximity to the opening drum 54 and a cam follower 128 operatively associated with the gripper 52 and mounted for rotation with the opening drum 54.

Preferably, the signature opening means includes a pair of grippers 52 diametrically spaced about the opening drum 54 of the delivery drum assembly 26 as shown in the drawings. Also, the signature gripping means preferably includes at least two and preferably three separate gripper assemblies 36 evenly spaced about the drum means 30 of the main drum assembly 24 as shown in the drawings.

Figure 4:
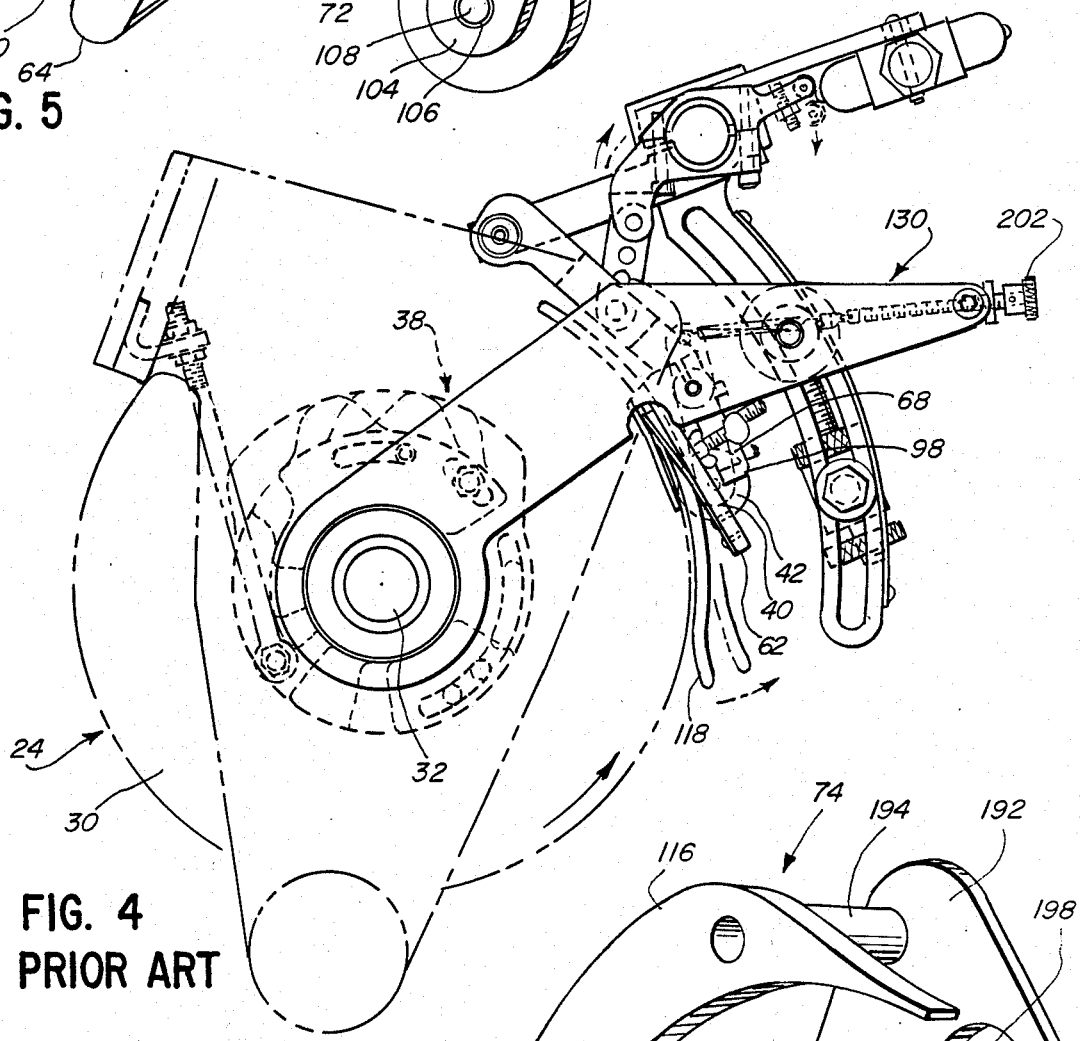
FIG. 4 PRIOR ART
FIG. 4 is a side elevational view of a main drum assembly of a conventional packer box.

Referring specifically to FIGS. 1 and 4, the register stops 40 and bracket supported guide rollers 42 are mounted on a rotatable bracket generally designated 130. The rotatable bracket 130 is mounted for rotation about the shaft 32 of the drum means 30 of the main drum assembly 24 for adjustably positioning the register stops 40 and guide rollers 42 within the limits of a conventional packer box 20. In addition, means are provided such as a conventional fastener for maintaining a selected position of adjustment for the rotatable bracket 130.

In operation, and referring first to FIG. 1, the packer box 20 causes the undersized signatures 34 to be carried toward the main drum assembly 24 by the signature feeding station 22. This occurs as a result of gravity and by reason of the belt 134 which is driven in indexed fashion by the toothed wheels 136 in a clockwise direction as shown together with cooperation of vacuum suckers (not shown) which separate a given signature 34 from the stack and pull the backbone toward the grippers 36. With this arrangement, the grippers 36 are adapted to grip one signature 34 at a time as the grippers 36 pass the signature feeding station 22.

Figure 12:
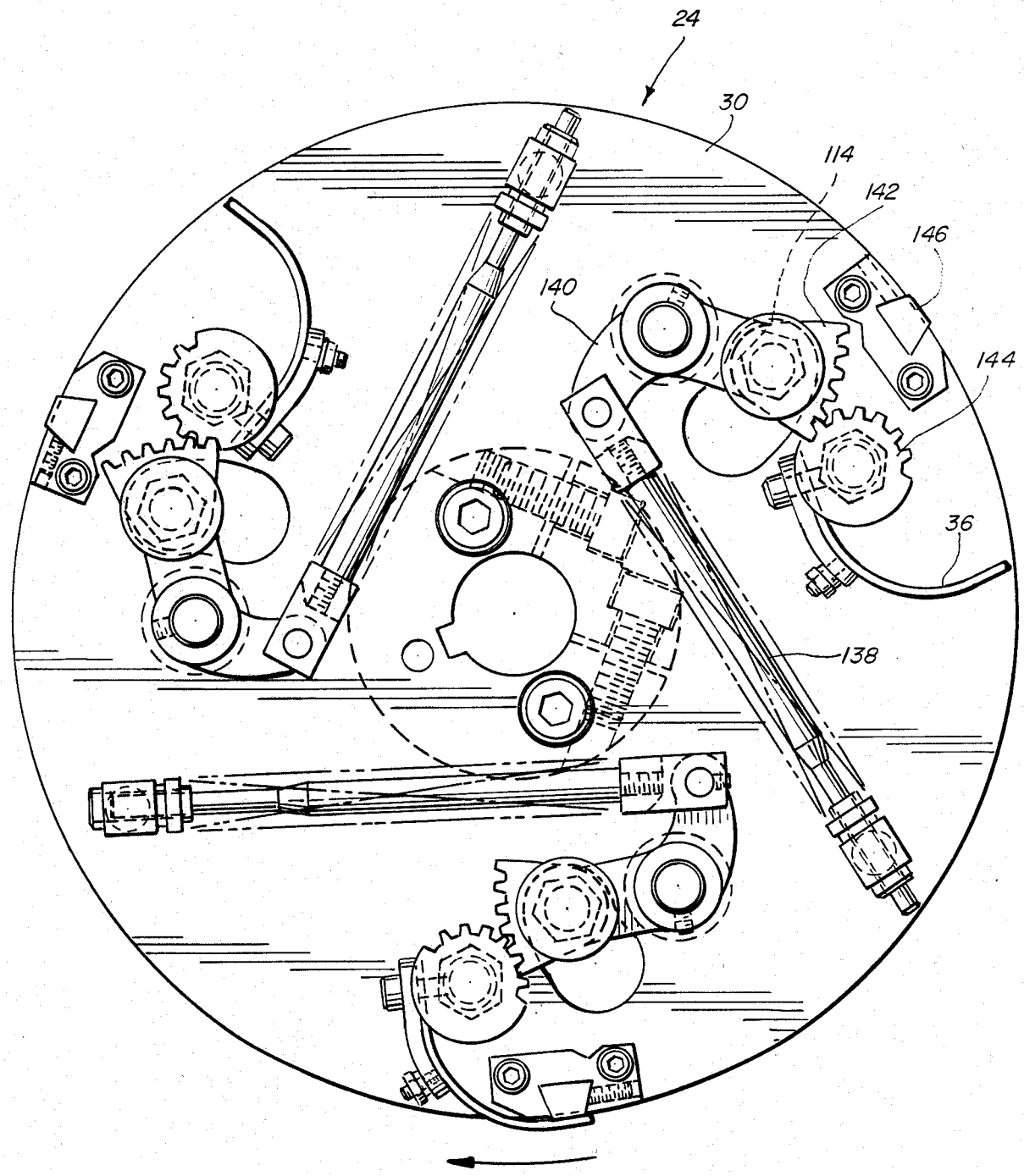
FIG. 12 is a side elevational view illustrating signature gripping means of a main drum assembly in accordance with the present invention.

Referring to FIGS. 9, 11 and 12, this occurs by reason of the operation of the grippers 36 as produced by the cam 112, cam extension 116, and cam follower 114. In other words, each of the grippers 36 is caused to close by the action of a spring 138 that acts on a crank 140 that pivots a toothed wheel segment 142 to drive a corresponding toothed wheel segment 144 causing the gripper 36 to close against a gripping surface 146 with a signature 34 therebetween. Then, as the cam follower 114 engages the cam extension 116, the toothed wheel segment 142 causes the toothed wheel segment 144 to be driven to open the gripper 36 thereby releasing the signature 34 as it reaches the guide rollers 42.

At that point, the air supply 48 diverts the signature 34 for movement with the transfer drum 44 in a clockwise direction past the roller 50 at which point one of the grippers 52 opens the signature 34. This occurs in a like cam fashion as can be appreciated by considering FIG. 3 wherein each of the grippers 52 which are normally biased by means of a spring is caused to be opened by means of the action of a cam follower 128 on a cam 126. As a result, the spring biasing causes the gripper 52 to open the signature 34 at the appropriate point of travel and the cam follower 128 and cam 126 cause the gripper 52 to release the signature 34 for deposit on the continuous signature carrying chain 28.

Referring to FIG. 3, the transfer drum 44 preferably includes two drum portions **44*a* and 44*b* and the opener drum 54 preferably comprises two drum portions 54*a* and 54*b*. It will be appreciated that means such as a line shaft (not shown) will preferably drive a bindery line of packer boxes including the packer box 20 as well as all of the driven components through a series of belts or chains 152,154 and 156 which operates, respectively, through pulleys 158 and 160, shaft 162, pulleys 164,166, 168,170 and 172, shaft 46, pulleys 174,176,178, and 180 and shaft 56. In addition, when the elongated finger 118 detects a choke up, it moves thereby displacing a microswitch which shuts off the whole bindery line giving a lighted signal as at 182**.

As shown in FIG. 2, the signature 34 will characteristically have a width "W" which, in a conventional packer box, will have a limit for the minimum width "W" on the order of 5⅛ inches from the backbone to the face of the signature. However, with the kit of the present invention, the width "W" may be, particularly in the case of a signature having a low folio and high folio, 2⅝ inches for the low folio and 3 inches for the high folio.

Referring to FIG. 7, it will be appreciated that the choke up detector bracket 120 includes a connecting flange 184 having a hole 186 therein. The hole 186 is, of course, adapted to receive the fastener 112 which also secures the guide roller extension bracket 66 to the bracket 68 normally supporting the guide roller 42. From the flange 184, the choke up detector bracket 120 includes a transversely extending leg 188 and a radially inwardly extending leg 190 from which the flange 122 projects.

Referring to FIGS. 8, 9 and 11, it will be appreciated that the cam extension 116 is joined to a mounting bracket 192 by means of a screw threaded spacer 194. It will also be seen that the mounting bracket 192 includes fastener receiving holes 196 and 198 to be utilized to secure the cam extension 116 in position so as to cooperate with the cam 112. In this manner, the cam follower 114 will control the movement of the grippers 36 to cause the release of the signatures 34 at the correct time.

As will be appreciated, the grippers 36 have to release the signatures 34 before they reach the stop walls 94 of the register stop extensions 58. If this does not occur, the signatures will be jammed into the stop walls 94 thus causing damage to the signatures and possible choke up.

To carry the signatures 34 the remaining distance to the register stop extensions 58, the guide rollers 42 are spring biased as at 200 in FIG. 9 which is adjustable by means of a knob 202 where the spring 200 acts against a crank 204 to pivot the guide roller extension brackets 66 to cause the guide rollers 42 to be in engagement with the surface of the drum portions 30*a* and 30*b* to carry the signatures up into the register stop extensions 58 until they contact the stop walls 94.

In practice, it has been found desirable to form the register stop extensions of aluminum/bronze. It is also desirable for the guide roller extension brackets to be formed of aluminum. In addition, the choke up detector brackets are preferably formed of stainless steel.

While in the foregoing specification there have been set forth preferred embodiments of the invention, it will be appreciated that the invention is to be limited only by the scope and spirit of the appended claims.

I claim:

1. A kit for handling undersized signatures in a packer box having a signature feeding station, a main drum assembly, a delivery drum assembly and a continuous signature carrying chain, said main drum assembly including drum means mounted for rotation on a shaft extending transversely of the direction of travel of signatures in said signature feeding station, said main drum assembly also including signature gripping means mounted for rotation with said drum means for gripping one signature at a time as said signature gripping means passes said signature feeding station, said main drum assembly further including means for releasing said signatures from said signature gripping means and stopping travel of said signatures with said drum means, said releasing and stopping means including timing means causing said gripping means to release said signatures at a preselected point during travel of said signatures with said drum means and a pair of spaced apart, adjustably positioned register stops downstream of said preselected point by a preselected distance and at least one bracket supported, adjustably positioned guide roller in engagement with said drum means to cause said signatures to travel with said drum means from said preselected point through said preselected distance to said register stops, said delivery drum assembly including a transfer drum mounted for rotation in a direction opposite rotation of said main drum assembly on a shaft extending parallel to said shaft of said main drum assembly, said delivery drum assembly also including means cooperating with said transfer drum to cause said signatures to travel with said transfer drum away from said register stops toward said continuous signature carrying chain, said delivery drum assembly further including signature opening means mounted for rotation with an opening drum in a direction opposite rotation of said transfer drum on a shaft extending parallel to said shaft of said transfer drum, said packer box being adapted to handle undersized signatures by using said kit, comprising:

a pair of register stop extensions adapted to be disposed in cooperative relation with said spaced apart register stops, each of said register stop extensions including a first end adapted to be secured to a receiving end of one of said adjustably positioned register stops and a second end defining a receiving end of said register stop extension, said register stop extensions being adapted to limit travel of said signatures with said drum means;

at least one guide roller extension bracket adapted to carry said guide roller, said guide roller being removable from said bracket normally supporting said guide roller and being securable on said guide roller extension bracket for rolling movement relative thereto, said guide roller extension bracket being securable to said bracket normally supporting said guide roller;

said guide roller extension bracket having a first end adapted to be secured to the end of said bracket normally supporting said guide roller in adjustably positioned fashion and a second end adapted to support said guide roller upstream of said preselected point in engagement with said drum means; and timing adjustment means for causing said gripping means to release said signatures at another preselected point generally corresponding to said second end of said guide roller extension bracket;

said register stop extensions being disposed downstream of said other preselected point by another preselected distance, said other preselected point and other preselected distance being adapted to accommodate handling of undersized signatures.

2. The kit for handling undersized signatures as defined by claim 1 wherein said receiving end of each of said register stops is defined by an elongated finger, said register stop extensions each including a channel at said first end thereof adapted to receive said elongated finger of one of said register stops in snug-fitting relation, and including means for securing said first ends of said register stop extensions to said elongated fingers of said register stops.

3. The kit for handling undersized signatures as defined by claim 2 wherein said channel of each of said register stop extensions is defined by an inner and outer wall, said outer wall being greater in length than said inner wall and having a pair of holes extending therethrough and adapted to register with a corresponding pair of threaded holes in one of said elongated fingers, said securing means including a pair of threaded fasteners adapted for threaded engagement with said threaded holes in one of said elongated fingers.

4. The kit for handling undersized signatures as defined by claim 1 wherein said register stop extensions each include a signature receiving slot at said second end thereof adapted to receive one of said signatures, said slot being defined by an outer finger having a rounded end and an inner finger having a first portion disposed at an acute angle so as to converge towards said outer finger in a direction inwardly of said slot and a second portion disposed generally parallel to said outer finger at the innermost end thereof, said inner and outer fingers defining an enlarged opening into said slot to facilitate receipt of one of said signatures therein.

5. The kit for handling undersized signatures as defined by claim 4 wherein said register stop extensions each are disposed relative to said drum means so as to facilitate receipt of one of said signatures in said signature receiving slot, said slot being defined by a stop wall at a point remote from said enlarged opening against which one of said signatures is stopped during travel of said signature with said drum means, said inner finger having said first portion disposed radially inwardly of the surface of said drum means at least at said enlarged opening thereof.

6. The kit for handling undersized signatures as defined by claim 1 wherein said guide roller extension bracket includes an attachment portion at said first end thereof, said attachment portion including an area of reduced thickness on one side of said guide roller extension bracket configured to correspond to the end of said bracket normally supporting said guide roller and having a hole therethrough adapted to register with a hole in said bracket normally supporting said guide roller, and including means for securing said attachment portion of said guide roller extension bracket to the end of said bracket normally supporting said guide roller.

7. The kit for handling undersized signatures as defined by claim 1 wherein said guide roller extension bracket includes a roller supporting portion at said second end thereof, said roller supporting portion including an area of reduced thickness on the one side of said guide roller extension bracket configured to receive said guide roller in a manner where said guide roller is disposed on said drum means of said main drum assembly and having a hole therein adapted to register with a hole in said guide roller, and including means for securing said guide roller to said roller supporting portion of said guide roller extension bracket for rolling engagement of said guide roller with said drum means.

8. The kit for handling undersized signatures as defined by claim 1 wherein said drum means includes first and second drum portions disposed in spaced relation along said shaft and including a pair of guide rollers with one of said guide rollers being in engagement with each of said first and second drum portions, said kit including a pair of guide roller extension brackets adapted to carry said guide rollers, said guide rollers being removable from said brackets normally supporting said guide rollers and being securable on said guide roller extension brackets for rolling movement on said first and second drum portions.

9. The kit for handling undersized signatures as defined by claim 1 wherein said timing means causing said gripping means to release said signatures at said preselected point during travel of said signatures with said drum means includes cam means, said cam means including a cam mounted in a fixed position in proximity to said drum means of said main drum assembly and a cam follower operatively associated with said gripping means and mounted for rotation with said drum means, said timing adjustment means comprising a cam extension adapted to be mounted in a fixed position in cooperative relation to said cam for causing said gripping means to release said signatures at said other preselected point generally corresponding to said second end of said guide roller extension bracket.

10. The kit for handling undersized signatures as defined by claim 1 including choke up detection means disposed in proximity to said drum means of said maim drum assembly, said choke up detection means including an elongated finger disposed proximate the surface of said drum means of said main drum assembly and being movable away from the surface of said drum means in the event of a choke up of said signatures to stop operation of said packer box, said kit including a choke up detector bracket adapted to be secured to said guide roller extension bracket and disposed between said drum means and elongated finger of said choke up detection means.

11. A kit for handling undersized signatures in a packer box having a signature feeding station, a main drum assembly, a delivery drum assembly and a continuous signature carrying chain, said main drum assembly including drum means mounted for rotation on a shaft extending transversely of the direction of travel of signatures in said signature feeding station, said main drum assembly also including signature gripping means mounted for rotation with said drum means for gripping one signature at a time as said signature gripping means passes said signature feeding station, said main drum assembly further including means for releasing said signatures from said signature gripping means and stopping travel of said signatures with said drum means, said releasing and stopping means including timing means causing said gripping means to release said signatures at a preselected point during travel of said signatures with said drum means and a pair of spaced apart register stops downstream of said preselected point by a preselected distance and at least one bracket supported guide roller in engagement with said drum means to cause said signatures to travel with said drum means from said preselected point through said preselected distance to said register stops, said delivery drum assembly including a transfer drum mounted for rotation in a direction opposite rotation of said main drum assembly on a shaft extending parallel to said shaft of said main drum assembly, said delivery drum assembly also including means cooperating with said transfer drum to cause said signatures to travel with said transfer drum away from said register stops toward said continuous signature carrying chain, said delivery drum assembly further including signature opening means mounted for rotation with an opening drum in a direction opposite rotation of said transfer drum on a shaft extending parallel to said shaft of said transfer drum, said packer box being adapted to handle undersized signatures by using said kit, comprising:

a pair of register stop extensions adapted to be disposed in cooperative relation with said spaced apart register stops, each of said register stop extensions including a first end adapted to be secured to a receiving end of one of said register stops and a second end defining a receiving end of said register stop extension, said register stop extensions being adapted to limit travel of said signatures with said drum means;

said receiving end of each of said register stops being defined by an elongated finger, said register stop extensions each including a channel at said first end thereof adapted to receive said elongated finger of one of said register stops in snug-fitting relation, and including means for securing said first ends of said register stop extensions to said elongated fingers of said register stops;

said register stop extensions also each including a signature receiving slot at said second end thereof adapted to receive one of said signatures, said slot being defined by an outer finger having a rounded end and an inner finger having a first portion disposed at an acute angle so as to converge toward said outer finger in a direction inwardly of said slot and a second portion disposed generally parallel to said outer finger at the innermost end thereof, said inner and outer fingers defining an enlarged opening into said slot to facilitate receipt of one of said signatures therein;

at least one guide roller extension bracket adapted to carry said guide roller, said guide roller being removable from said bracket normally supporting said guide roller and being securable on said guide roller extension bracket for rolling movement relative thereto, said guide roller extension bracket being securable to said bracket normally supporting said guide roller;

said guide roller extension bracket having a first end adapted to be secured to the end of said bracket normally supporting said guide roller and a second end adapted to support said guide roller upstream of said preselected point in engagement with said drum means;

said guide roller extension bracket including an attachment portion at said first end thereof, said attachment portion including an area of reduced thickness on one side of said guide roller extension bracket configured to correspond to the end of said bracket normally supporting said guide roller and having a hole therethrough adapted to register with a hole in said bracket normally supporting said guide roller, and including means for securing said attachment portion of said guide roller extension bracket to the end of said bracket normally supporting said guide roller;

said guide roller extension bracket including a roller supporting portion at said second end thereof, said roller supporting portion including an area of reduced thickness on one side of said guide roller extension bracket configured to receive said guide roller in a manner where said guide roller is disposed on said drum means of said main drum assembly and having a hole therein adapted to register with a hole in said guide roller, and including means for securing said guide roller to said roller supporting portion of said guide roller extension bracket for rolling engagement of said guide roller with said drum means; and timing adjustment means for causing said gripping means to release said signatures at another preselected point generally corresponding to said second end of said guide roller extension bracket, said timing means including cam means defined by a cam mounted in a fixed position in proximity to said drum means of said main drum assembly and a cam follower operatively associated with said gripping means and mounted for rotation with said drum means, said timing adjustment means comprising a cam extension adapted to be mounted in a fixed position in cooperative relation to said cam for causing said gripping means to release said signatures at said other preselected point generally corresponding to said second end of said guide roller extension bracket;

said register stop extensions being disposed downstream of said other preselected point by another preselected distance, said other preselected point and other preselected distance being adapted to accommodate handling of undersized signatures.

12. The kit for handling undersized signatures as defined by claim 11 wherein said channel of each of said register stop extensions is defined by an inner and outer wall, said outer wall being greater in length than said inner wall and having a pair of holes extending therethrough and adapted to register with a corresponding pair of threaded holes in one of said elongated fingers, said securing means including a pair of threaded fasteners adapted for threaded engagement with said threaded holes in one of said elongated fingers.

13. The kit for handling undersized signatures as defined by claim 11 wherein said register stop extensions each are disposed relative to said drum means so as to facilitate receipt of one of said signatures in said signature receiving slot, said slot being defined by a stop wall at a point remote from said enlarged opening against which one of said signatures is stopped during travel of said signature with said drum means, said inner finger having said first portion disposed radially inwardly of the surface of said drum means at least at said enlarged opening thereof.

14. The kit for handling undersized signatures as defined by claim 11 wherein said drum means includes first and second drum portions disposed in spaced relation along said shaft and including a pair of guide rollers with one of said guide rollers being in engagement with each of said first and second drum portions, said kit including a pair of guide roller extension brackets adapted to carry said guide rollers, said guide rollers being removable from said brackets normally supporting said guide rollers and being securable on said guide roller extension brackets for rolling movement on said first and second drum portions.

15. The kit for handling undersized signatures as defined by claim 11 including choke up detection means disposed in proximity to said drum means of said maim drum assembly, said choke up detection means including an elongated finger disposed proximate the surface of said drum means of said main drum assembly and being movable away from the surface of said drum means in the event of a choke up of said signatures to stop operation of said packer box, said kit including a choke up detector bracket adapted to be secured to said guide roller extension bracket and disposed between said drum means and elongated finger of said choke up detection means.

16. The kit for handling undersized signatures as defined by claim 11 wherein said register stops and bracket supported guide roller are mounted on a rotatable bracket, said rotatable bracket being mounted for rotation about said shaft of said drum means of said main drum assembly for adjustably positioning said register stops and guide roller, and including means for maintaining said rotatable bracket in a selected position of adjustment.

17. The kit for handling undersized signatures as defined by claim 11 wherein said signature kit gripping means includes at least two separate gripper assemblies evenly spaced about said drum means of said main drum assembly.

* * * * *